US011987896B2

(12) United States Patent
Pérez Gallent et al.

(10) Patent No.: US 11,987,896 B2
(45) Date of Patent: May 21, 2024

(54) ELECTROCHEMICAL PRODUCTION OF FORMALDEHYDE

(71) Applicant: Nederlandse Organisatie voor toegepast-natuurwetenschappelijk onderzoek TNO, The Hague (NL)

(72) Inventors: Elena Pérez Gallent, Leiden (NL); Earl Lawrence Vincent Goetheer, Mol (BE); Francesc Sastre Calabuig, Eindhoven (NL)

(73) Assignee: Nederlandse Organisatie voor toegepast-natuurwetenschappelijk onderzoek TNO, 's-Gravenhage (NL)

( * ) Notice: Subject to any disclaimer, the term of this patent is extended or adjusted under 35 U.S.C. 154(b) by 0 days.

(21) Appl. No.: 17/793,717

(22) PCT Filed: Jan. 25, 2021

(86) PCT No.: PCT/NL2021/050044
§ 371 (c)(1),
(2) Date: Jul. 19, 2022

(87) PCT Pub. No.: WO2021/150117
PCT Pub. Date: Jul. 29, 2021

(65) Prior Publication Data
US 2023/0050891 A1 Feb. 16, 2023

(30) Foreign Application Priority Data
Jan. 24, 2020 (EP) ..... 20153709

(51) Int. Cl.
*C25B 3/07* (2021.01)
*C25B 3/25* (2021.01)
*C25B 9/19* (2021.01)

(52) U.S. Cl.
CPC ..... *C25B 3/07* (2021.01); *C25B 3/25* (2021.01); *C25B 9/19* (2021.01)

(58) Field of Classification Search
CPC ..... C25B 3/07; C25B 3/25
USPC ..... 205/448
See application file for complete search history.

(56) References Cited

PUBLICATIONS

Silvestri et al., "Electrochemical Reduction of Vanadium Salts under Carbon Monoxide. Synthesis of Tetrabutylammonium Hexacarbonylvanadate (-l)," Journal of the Chemical Society, Dalton Transactions (1972), vol. 22, pp. 2558-2559. (Year: 1972).*
Goodridge et al., "The Electrolytic Reduction of Carbon Dioxide and Monoxide for the Production of Carboxylic Acids," (Nov. 1984), vol. 14, No. 6, pp. 791-796. (Year: 1984).*
Han et al., "High-Rate Electrochemical Reduction of Carbon Monoxide to Ethylene Using Cu-Nanoparticle-Based Gas Diffusion Electrodes," ACS Energy Letters (Mar. 13, 2018), vol. 3, No. 4, pp. 855-860. (Year: 2018).*

(Continued)

*Primary Examiner* — Edna Wong
(74) *Attorney, Agent, or Firm* — Hoffmann & Baron LLP

(57) ABSTRACT

The invention is directed to a process for the preparation of formaldehyde, the process comprising electrochemically reducing CO to form formaldehyde. The process is carried out in a supporting electrolyte that comprises less than 50% water and a non-aqueous solvent such as an alcohol.

21 Claims, 4 Drawing Sheets

(56) References Cited

PUBLICATIONS

Cuellar et al., "Advantages of CO over CO2 as Reactant for Electrochemical Reduction to Ethylene, Ethanol and n-Propanol on Gas Diffusion Electrodes at High Current Densities," Electrochimica Acta (Jun. 1, 2019), vol. 307, pp. 164-175. (Year: 2019).*

Hori, Yoshio, et al. "Electroreduction of Carbon Monoxide to Methane and Ethylene at a Copper Electrode in Aqueous Solutions at Ambient Temperature and Pressure," Journal of the American Chemical Society, vol. 109, No. 16, pp. 5022-5023 (1987).

Figeiredo, Marta C., et al., "In Situ Spectroscopic Study of CO2 Electroreduction at Copper Electrodes in Acetonitrile," ACS Catalysis, vol. 6, No. 4, pp. 2382-2392 (2016).

Schouten, Klaas Jan P., et al. "Two Pathways for the Formation of Ethylene in CO Reduction on Single-Crystal Copper Electrodes," Journal of the American Chemical Society, vol. 134, No. 24, pp. 9864-9986 (2012). (Abstract only.).

Pérez-Gallent, Elena, et al. "Structure-and Potential-Dependent Cation Effects on CO Reduction at Copper Single-Crystal Electrodes," Journal of the American Chemical Society, vol. 139, No. 45, pp. 16412-16419 (2017).

Millar, Graeme J., et al., "Industrial Production of Formaldehyde Using Polycrystalline Silver Catalyst," Industrial & Engineering Chemistry Research, vol. 56, No. 33, pp. 9247-9265 (2017). https://eprints.qut.edu.au/111044/.

Kowatsch, Stefan, "Phenolic Resins: A Century of Progress", Pilato, Louis, ed., Chapter 3 "Formaldehyde", pp. 24-40, New York: Springer, 2010.

Hori, Yoshio, et al. "Electrochemical Reduction of Carbon Monoxide to Hydrocarbons at Various Metal Electrodes in Aqueous Solution," Chemistry Letters, vol. 16, No. 8, pp. 1665-1668 (1987).

Birdja, Yuvraj Y., et al., "The Importance of Cannizzaro-Type Reactions During Electrocatalytic Reduction of Carbon Dioxide," Journal of the American Chemical Society, vol. 139, No. 5, pp. 2030-2034 (2017).

* cited by examiner

ELECTROCHEMICAL PRODUCTION OF FORMALDEHYDE

CROSS-REFERENCE TO RELATED APPLICATIONS

This application is a U.S. National Phase application of International Application No. PCT/NL2021/050044 filed Jan. 25, 2021, which claims priority to European Patent Office application number EP 20153709.9, filed Jan. 24, 2020, the disclosures of which are incorporated herein by reference.

Field of the Invention

The invention is in the field of formaldehyde production. In particular the invention is directed to production of formaldehyde from carbon monoxide (CO).

Background of the Invention

Formaldehyde is considered an important building block used in many chemical industries. For instance, amongst many other applications, it is used in the manufacturing process of vaccines and as a disinfectant in the health industry, used in the manufacturing process of glues and resins, and used in the textile industry as a binder for pigments.

Conventionally, formaldehyde is industrially mostly produced from methanol by the following three processes: partial oxidation and dehydrogenation with air in the presence of silver crystals, steam, and excess methanol at 650-720° C. (BASF Process); partial oxidation and dehydrogenation with air in the presence of crystalline silver or silver gauze, steam, and excess methanol at 600-650° C. (incomplete conversion); or oxidation only with excess air in the presence of a modified iron-molybdenum-vanadium oxide catalyst at 250-400° C. (formox process), see also Franz et al. "Formaldehyde" in Ullmann's Encyclopedia of Industrial Chemistry, 2016. It is however, beneficial to produce formaldehyde from a commodity material such as CO. However, there are no economically viable methods available for the direct conversion of CO to formaldehyde.

One conventional method to produce formaldehyde is based upon hydrogenation of CO. When the hydrogenation of CO takes place in a gas phase, the process is thermodynamically limited leading to a very low conversion of CO (ca. $1\times10^{-4}$%, see e.g. Bahmanpour, et al., Green Chemistry 17 (2015) 3500-3507). A slightly higher conversion of CO (ca. 19%) can be achieved if the hydrogenation reaction is performed in liquid phase. However, the process requires high temperatures and high pressures.

Nakata et al. Angewandte Chemie International Edition 53 (2014) 871-874 describe the electrochemical oxidation of $CO_2$ to formaldehyde, formic acid, methyl formate, CO and methane using various electrode materials. The drawback of using $CO_2$ to form formaldehyde however, is that $CO_2$ reduction requires many electrons and concomitantly concerns a high energy demand. However, attempts to electrochemically reduce other materials such as CO has exclusively led to the production of compounds other than formaldehyde, e.g. methane, ethylene, methane, formic acid, acetic acid, propanol, ethanol and the like (see for instance Birdja, Journal of the American Chemical Society 139 (2017) 2030-2034).

Accordingly, there remains a desire to provide improved processes for the production of formaldehyde from a material such as CO, in particular in terms of higher yields and/or efficiencies.

SUMMARY OF THE INVENTION

Figure 1:
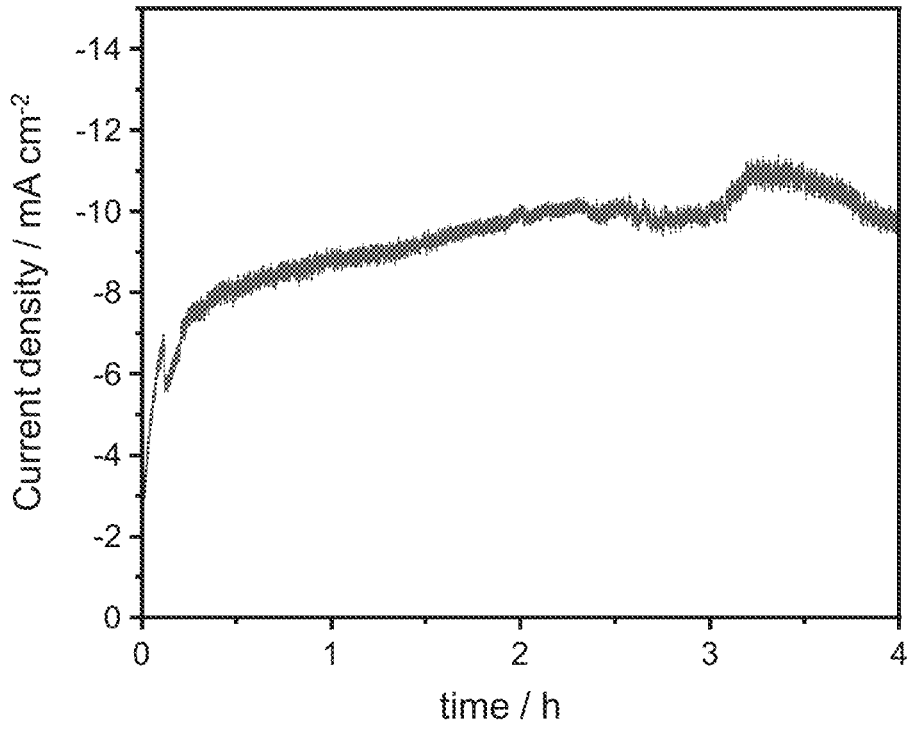
FIG. 1 illustrates the current density versus time for a electrochemical reduction of CO in a KOH in methanol solution as electrolyte at −2.5V vs Ag/AgCl.

Surprisingly, the present inventors have found that formaldehyde can be formed from CO by electrochemical reduction. This reaction is believed to proceed according to equation 1:

$$CO+2H^{+}+2e^{-}\rightarrow H_2CO \quad (1)$$

Accordingly, the present invention is directed to a process for the preparation of formaldehyde, said process comprising electrochemically reducing CO to form formaldehyde.

The present inventors found that the electrochemical reduction of CO (herein-after also simply referred to as the reduction) can advantageously be carried out in a supporting electrolyte that comprises a solvent and comprises less than 50% water. This can be achieved by using a non-aqueous solvent. It was found that good yields are accordingly attainable. Moreover, advantageously, the use of non-aqueous solvents allows efficient downstream processes for the isolation of formaldehyde.

Without wishing to be bound by theory, the inventors believe that the use of the non-aqueous solvent prevents or at least limits the water splitting (i.e. the reduction of water to hydrogen and oxygen) and that as such the selectivity of the reduction to formaldehyde can be improved. The present process thus preferably comprises measure to limit water splitting from taking place.

DETAILED DESCRIPTION

As used herein, solvent may refer to a single solvent or to a mixture of solvents. The solvent at least comprises the non-aqueous solvent, which refers to a solvent other than water. The non-aqueous solvent may be a polar or an apolar solvent. In the art, apolar solvent are solvents having no dipole moment, while polar solvent are solvent which have a dipole moment. Highly symmetrical molecules (e.g. benzene) and aliphatic hydrocarbons (e.g. hexane) have no dipole moment and are thus considered non-polar. Dimethyl sulfoxide, ketones, esters, alcohol are examples of compounds having dipole moments (from high to medium, sequentially) and they are thus polar solvents (see e.g. Wypych, G., *Handbook of Solvents*, Toronto-New York, 2001). Examples of apolar solvents are accordingly organic solvents such as pentane, hexane, toluene, benzene, tetrachloromethane, diethyl ether and the like. Examples of suitable polar solvents include dimethyl formamide (DMF), acetonitrile, tetrahydrofuran (THF) and the like. The non-aqueous solvent may also be a protic or a aprotic solvent. The specifically aforementioned polar and apolar solvents are generally aprotic. Examples of suitable protic, polar solvents include alcohols, which are accordingly preferred. Particularly good results were obtained by using a solvent selected from the group consisting of $C_1$-$C_8$ alcohols such as methanol, ethanol, n-propanol, isopropanol, n-butanol, isobutyl alcohol, tert-butanol, n-amyl alcohol, tert-amyl alcohol. Methanol is most preferred.

Without wishing to be bound by theory, the present inventors believe that the formaldehyde that is formed forms an adduct with the alcohol which stabilizes the formaldehyde. Therefore limited disproportionation of the formaldehyde may occur.

The supporting electrolyte in which the reduction is carried out comprises less than 50% water, preferably less than 20% water, more preferably less than 15% water, most preferably less than 5% water, based on total weight of the solvent or solvents present in the supporting electrolyte. It is believed that this is one of the possible measures to limit water splitting. Most preferably, the supporting electrolyte comprises less than 1% water such as essentially no water. In practice however, the present of water can typically not be avoided, in particular since water is a preferred solvent for the counter reaction of the reduction, i.e. the oxidation of water (vide infra).

The supporting electrolyte generally is a liquid that comprises the solvent and one or more chemical compounds to improve conductivity whilst not being electrochemically active in the applied potential in the process (see also Pure & Applied Chemistry (1985), Vol. 57, No. 10, pp. 1491-1505). These one or more chemical compounds are herein also referred to as electrolyte solutes. Examples of traditional electrolyte solutes used to form the supporting electrolyte that may also be suitable for the present process are those selected from the group consisting of carbonates, bicarbonates, hydroxides, halides, perchlorates and sulfates. Specific examples of suitable chemical compounds to form the supporting electrolyte include cesium hydroxide, sodium hydroxide, potassium hydroxide, sulfuric acid, potassium bicarbonate, tetraalkylammonium salts like tetrabutylammonium salts and tetraethylammonium salts such as tetraethylammoniumperchorate and tetraethylammonium chloride. In view of the preferred non-aqueous solvent for use in the supporting electrolyte, electrolyte solutes that are soluble in the non-aqueous solvent (which electrolyte solutes are herein also referred to a non-aqueous electrolyte solutes) are highly preferred. Various suitable non-aqueous electrolyte solutes are described in Janz and Tomkins, Nonaqueous Electrolytes Handbook, Volume I and II, Academic Press, Inc. (1973). Examples of non-aqueous electrolyte solutes include tetraalkylammonium salts, e.g. the aforementioned tetraethylammonium chloride or tetraethylammonium bromide. Preferably, the one or more electrolyte solutes have a high conductivity.

As is typical for electrochemical process, the present process is preferably carried out in two-compartment electrochemical cell. Any type of electrochemical cell may in principle be usable, both in stagnant conditions (e.g. batch cells) or in continuous or semi-continuous conditions (e.g. flow cells). Suitable examples include microreactors, H-cells and filter press electrochemical flow cells. A filter press electrochemical flow cell is particularly preferred as this would allow a semi-continuous or continuous process. The electrochemical cell comprises a cathodic compartment with a cathode at which CO can be reduced. The cathode is generally required to adsorb the reactant (i.e. CO) and to desorb the product (i.e. formaldehyde), thereby fulfilling a catalytic activity. The adsorption/desorption balance should be appropriate to sufficiently reduce the CO while subsequently sufficiently releasing the product to not block the cathode for further conversions. Good results were obtained with a cathode comprising carbon doped materials and carbon-based materials such as boron-doped diamond (BDD), as these gave particularly high yields. Other suitable and preferred carbon-based materials include graphite, carbon felt and glassy carbon (GC). The cathode may alternatively or additionally also comprise one or more metals such a copper, tin, platinum, gold, silver, lead, tungsten and the like. Appropriate materials for the cathode can be found using screening techniques including density functional theory.

Ideally the potential at which the reduction is carried out is as low as possible. The reduction is typically carried out with a voltage in the range of −0.1 to −10 V vs Ag/AgCl cathode potential, preferably −0.1 to −5 V vs Ag/AgCl) cathode potential, such as about −2.5 to −3 V. The potential at which the reduction is carried out may also function as a measure to limit reductive water splitting and/or reductive decomposition of the solvent. For instance, the potential may be chosen such that minimal or no water splitting occurs and/or minimal or no reductive decomposition of the solvent occurs.

The electrochemical cell generally further comprises an anodic compartment that is separated from the cathodic compartment by a cationic exchange membrane (CEM), by an anionic exchange membrane (AEM) or by a bipolar membrane (BPM) and wherein the process further comprises oxidizing a reducing agent such as water and/or hydroxide to oxygen and protons, as illustrated in equations 2a and 2b.

$$H_2O \rightarrow O_2 + 2H^+ + 2e^- \quad (2a)$$

$$2OH^- \rightarrow O_2 + 2H^+ + 4e^- \quad (2b)$$

The protons produced on the anodic side can cross the membrane to the cathodic compartment wherein they can be consumed in the reduction to form formaldehyde.

The cathode can comprise a plate electrode, a foam electrode, a mesh electrode (3-D electrode), a gas diffusion electrode, or a combination thereof. In a particularly preferred embodiment, the cathode comprises a gas diffusion electrode (GDE), as these can be advantageous for gas/liquid reactions. In the art, GDEs have previously be used in for instance $CO_2$ reduction (cf. for example Burdyny and Smith, Energy & Environmental Science 12 (2019) 1442-1453). Accordingly, in such a particularly preferred embodiment, the electrochemical cell preferably further comprises a gas compartment that is in gaseous connection to the gas diffusion electrode. In the case that a plate or a 3-D electrode is used instead of a gas diffusion electrode; the gas compartment is generally not necessary. The CO gas can then be dissolved (preferably saturated) in the supporting electrolyte. Since the reactant CO is a gas, it is also preferred to carry out the reduction at an elevated pressure, preferably at a pressure of at least 10 bar, more preferably at least 20 bar, such as about 30 bar. Nonetheless, it may also be feasible to carry out the reduction at ambient pressures (approximately 1 bar).

Further, it is preferred that the reduction is carried out at a temperature between 0 and 150° C., such as between 10° C. and 140° C. Preferably the reduction is carried out at a temperature between 20° C. and 90° C.

The present invention is not necessarily limited to CO having a specific origin or a specific purify. For instance, the CO which is reduced in the present process may be part of a stream comprising other impurities such as $CO_2$, $N_2$ and $H_2$. Accordingly, a particular embodiment of the present invention comprises providing a stream comprising CO and optionally other components such as $CO_2$, $N_2$ and $H_2$ and leading said stream into the electrochemical cell before said electrochemically reducing CO to form formaldehyde is carried out.

As used herein, the singular forms "a", "an" and "the" are intended to include the plural forms as well, unless the context dearly indicates otherwise. The term "and/or" includes any and all combinations of one or more of the associated listed items. It will be understood that the terms "comprises" and/or "comprising" specify the presence of stated features but do not preclude the presence or addition of one or more other features.

For the purpose of clarity and a concise description features are described herein as part of the same or separate embodiments, however, it will be appreciated that the scope of the invention may include embodiments having combinations of all or some of the features described.

The present invention can be illustrated by the following non-limiting examples.

EXAMPLES

Example 1—Carbon Monoxide Reduction Using MeOH as Electrolyte

Figure 2:
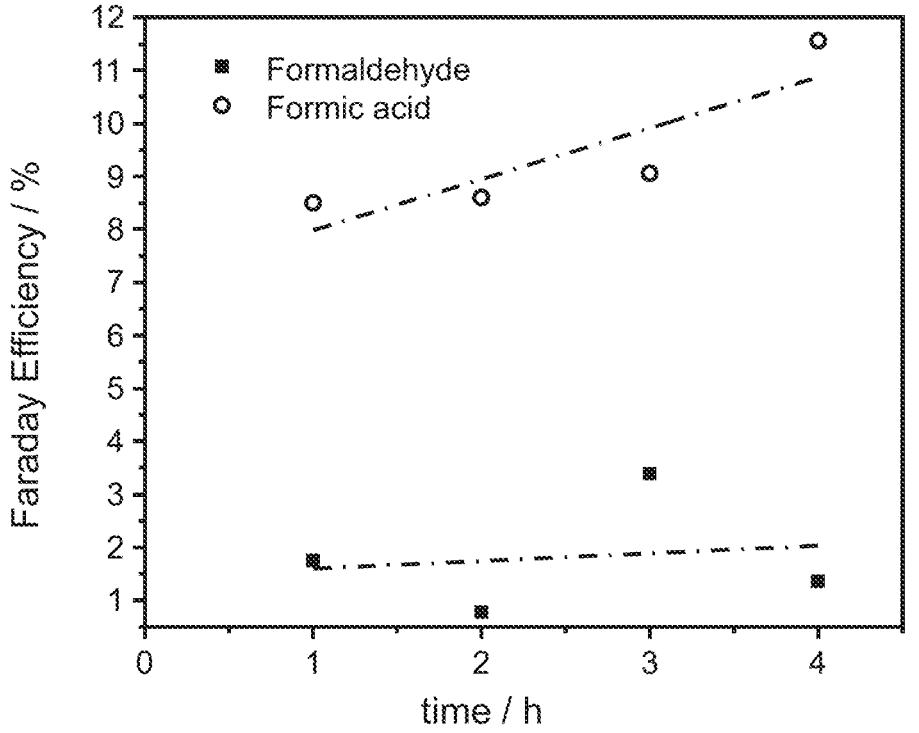
FIG. 2 illustrates the Faradaic efficiency versus time with a current density of ca. 8 mA $cm^{-2}$ for a electrochemical reduction of CO in a KOH in methanol solution and as electrolyte at −2.5V vs Ag/AgCl.

A two-compartment electrochemical cell was employed for CO electroreduction experiments. The compartments were separated by a proton conductive membrane. The cathodic compartment is equipped with working (WE) and reference (RE) electrodes. The working electrode comprised a metal plate with a surface area of 10 $cm^2$ located at a distance of 5 mm from the membrane. A Ag/AgCl electrode was used as reference electrode. The anodic compartment was equipped with a platinum electrode as counter electrode (CE) at a distance of 0.5 cm from the membrane. The temperature in both cathodic and anodic compartments was controlled separately in the range between 5-100° C. with an accuracy of less than 1° C. using a heating/cooling bath. The reactor is connected to a potentiostat Instrument. A 0.1 M KOH in methanol solution was used as a supporting electrolyte. CO was presaturated into the catholyte and was continuously bubbling into the solution with a rate of 16 ml/min of CO. The reaction applied potential was −2.5V vs Ag/AgCl during 4 h. In FIG. 1, the current density at −2.5V vs Ag/AgCl is shown. Liquid aliquots were taken every hour and analyzed by high performance liquid chromatography (HPLC) and gas chromatography (GC). At the indicated potential, formic acid and formaldehyde were detected as main CO reduction products with a faradaic efficiency of 4% in formic acid and 1% in formaldehyde with a current density of about 10 mA $cm^{-2}$ (see FIG. 2).

Example 2—Carbon Monoxide Reduction Using MeOH as Electrolyte

Figure 3:
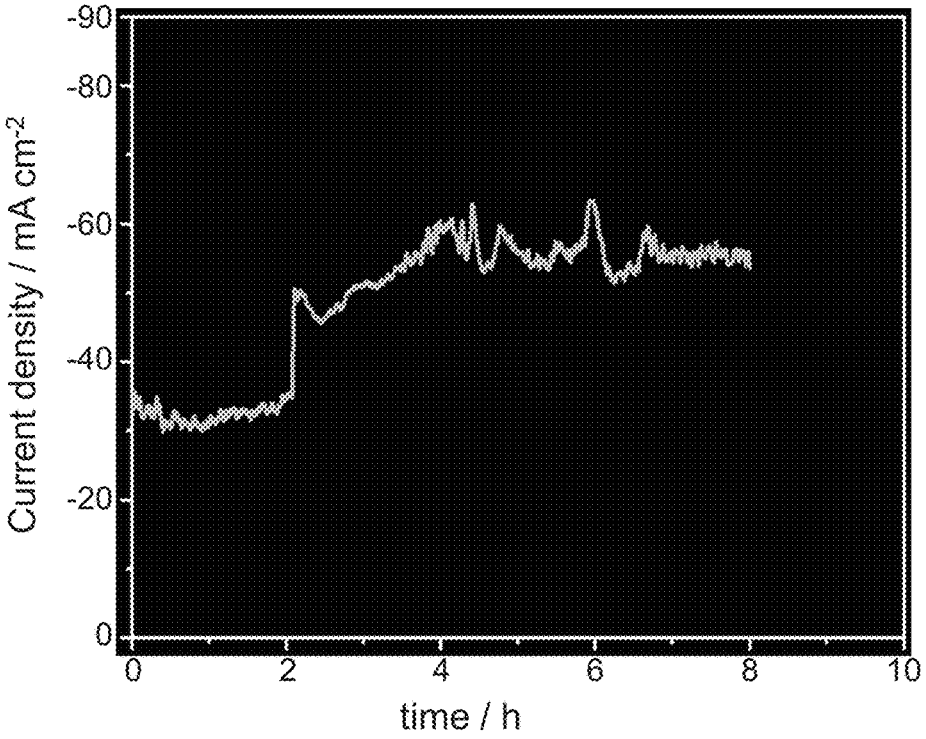
FIG. 3 illustrates the current density versus time obtained during the electrochemical reduction of CO in a tetraethylammonium chloride in methanol solution as electrolyte on BDD electrode at −2.5 V vs Ag/AgCl.
Figure 4:
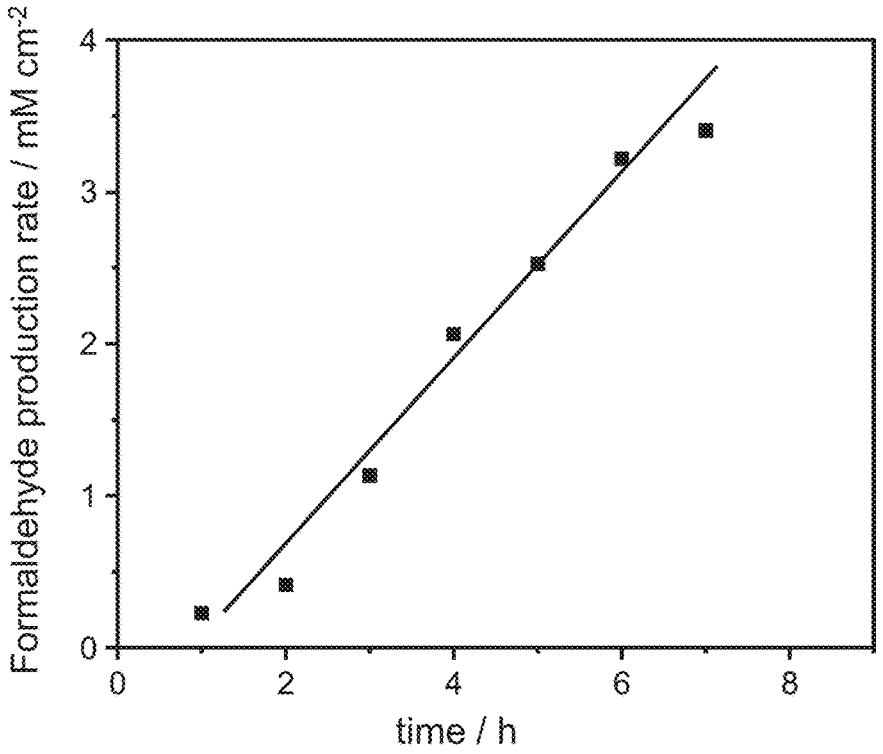
FIG. 4 illustrates the formaldehyde production rate versus time obtained in the electrochemical reduction of CO in a tetraethylammonium chloride in methanol solution as electrolyte on BDD electrode as −2.5 V vs Ag/AgCl.
Figure 5:
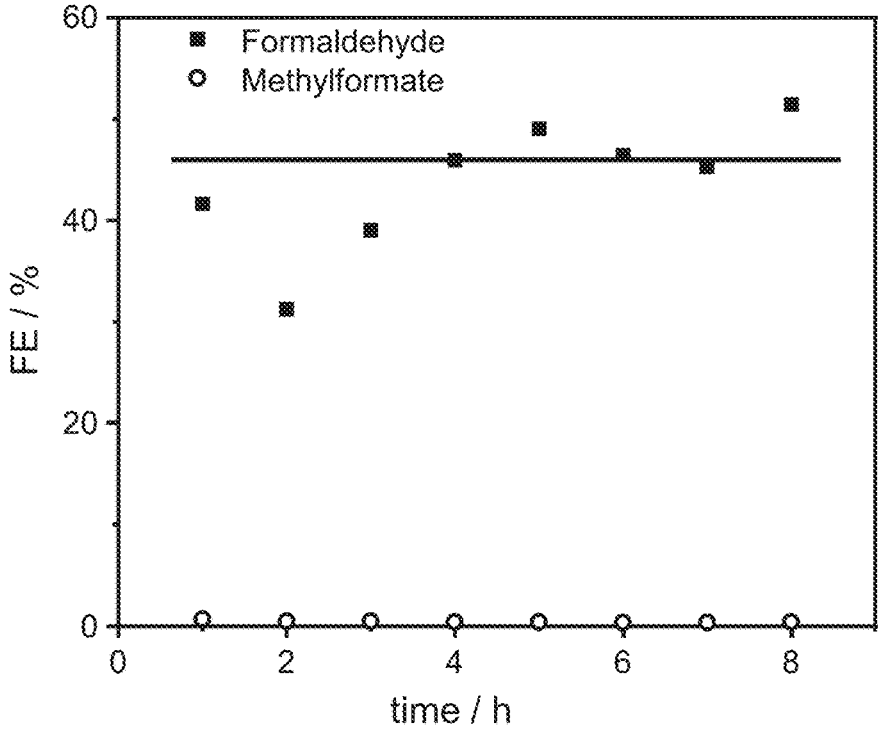
FIG. 5 illustrates the Faradaic efficiency towards formaldehyde and methylformate versus time obtained with a current density of ca. 50 mA $cm^{-2}$ in the electrochemical reduction of CO in a tetraethylammonium chloride in methanol solution as electrolyte on BDD electrode at −2.5 V vs Ag/AgCl.

A two-compartment electrochemical cell was employed for CO electroreduction experiments. The compartments were separated by a proton conductive membrane. The cathodic compartment is equipped with working (WE) and reference (RE) electrodes. The working electrode comprised a metal plate with a geometrical surface area of 10 $cm^2$ located at a distance of 5 mm from the membrane. A Ag/AgCl electrode was used as reference electrode. The anodic compartment was equipped with a platinum electrode as counter electrode (CE) at a distance of 0.5 cm from the membrane. The reactor is connected to a potentiostat Instrument. Tetraethylammonium chloride was dissolved in methanol solution until the conductivity was 10 mS/m and was used as a supporting electrolyte for the working electrode. The counter electrode compartment was filled with 0.1M $H_2SO_4$ solution. CO was presaturated into the catholyte and was continuously bubbling into the solution with a rate of 16 ml/min of CO during at least 1 h. The reaction applied potential was −2.5V vs Ag/AgCl during 8 h. Liquid aliquots were taken every hour and analyzed by liquid chromatography (HPLC), Gas Chromatography (GC) and Fourier transform infrared spectroscopy (FTIR). At the indicated potential, formaldehyde was detected as main CO reduction products with a faradaic efficiency of ca. 45% with a current density of ca. 50 mA $cm^{-2}$ (see FIGS. 3-5).

Figure 6:
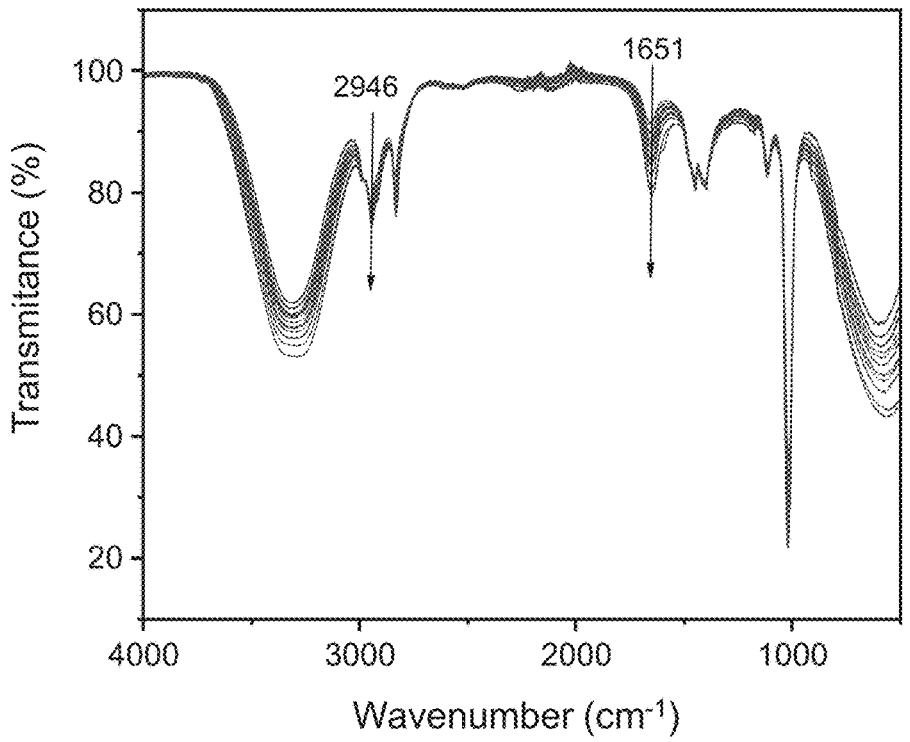
FIG. 6 illustrates the FTIR spectrum over time measured during the electrochemical reduction of CO in a tetraethylammonium chloride in methanol solution as electrolyte on BDD electrode at −2.5 V vs Ag/AgCl.

With increasing reaction time, the spectral band measured with FTIR associated with formaldehyde were increasing (see FIG. 6), indicating increasing formation of formaldehyde during CO electrolysis at −2.5V vs. Ag/AgCl using methanol solution and BDD as cathode electrode. The formaldehyde formation can be seen in the decrease of transmittance for the doublet C—H at roughly 2925 $cm^{-1}$ and the decrease of the peak at about 1651 $cm^{-1}$ that can be assigned to the carbonyl group.

Example 3—Carbon Monoxide Reduction Using EtOH as Electrolyte

A two-compartment electrochemical cell was employed for CO electroreduction experiments. The compartments were separated by a proton conductive membrane. The cathodic compartment is equipped with working (WE) and reference (RE) electrodes. The working electrode comprised a metal plate with a geometrical surface area of 10 $cm^2$ located at a distance of 5 mm from the membrane. A Ag/AgCl electrode was used as reference electrode. The anodic compartment was equipped with a platinum electrode as counter electrode (CE) at a distance of 0.5 cm from the membrane. The reactor is connected to a potentiostat Instrument. A Tetraethylammonium chloride was dissolved in ethanol solution until the conductivity was 10 mS/m and was used as a supporting electrolyte for the working electrode. The counter electrode compartment was filled with 0.1M $H_2SO_4$ solution. CO was presaturated into the catholyte and was continuously bubbling into the solution with a rate of 16 ml/min of CO during at least 1 h. The reaction applied potential was −2.5V vs Ag/AgCl during 8 h. Liquid aliquots were taken every hour and analyzed by liquid chromatography (HPLC), Gas Chromatography (GC) and Fourier transform infrared spectroscopy (FTIR). Formaldehyde was not detected with HPLC or GC, probably due to the product concentration is below the detection limit of the instruments.

Figure 7:
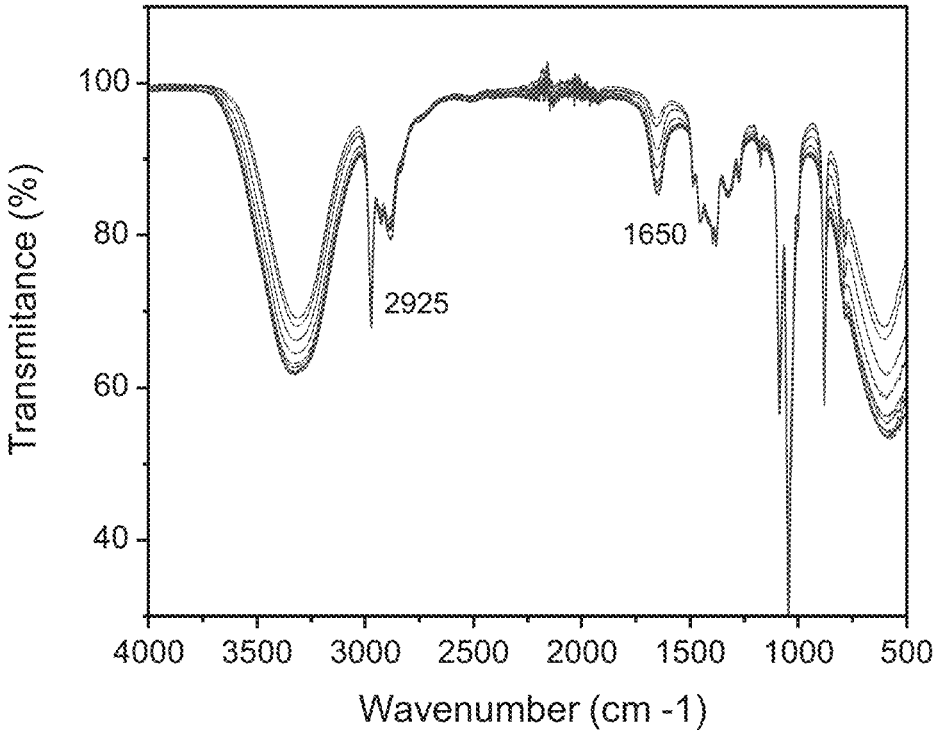
FIG. 7 illustrates the FTIR spectrum over time measured during the electrochemical reduction of CO in a tetraethylammonium chloride in ethanol solution as electrolyte on BDD electrode at −2.5 V vs Ag/AgCl.

With a more sensitive technique (FTIR), the bands associated to formaldehyde were observed, and with increasing reaction time the spectral band associated with formaldehyde were increasing (see FIG. 7). The formaldehyde formation can be seen in the decrease of transmittance for the doublet C—H at approximately 2925 $cm^{-1}$ and the decrease of the peak at about 1650 $cm^{-1}$ that can be assigned to the carbonyl group.

Example 4—Carbon Monoxide Reduction Using Isopropanol (IPA) as Electrolyte

A two-compartment electrochemical cell was employed for CO electroreduction experiments. The compartments were separated by a proton conductive membrane. The cathodic compartment is equipped with working (WE) and reference (RE) electrodes. The working electrode comprised a metal plate with a geometrical surface area of 10 $cm^2$ located at a distance of 5 mm from the membrane. A Ag/AgCl electrode was used as reference electrode. The anodic compartment was equipped with a platinum electrode as counter electrode (CE) at a distance of 0.5 cm from the membrane. The reactor is connected to a potentiostat Instrument. A Tetraethylammonium chloride was dissolved in isopropanol solution until the conductivity was 8 mS/m and was used as a supporting electrolyte for the working electrode. The conductivity could not be increased further due to the solubility of the salt in isopropanol. The counter electrode compartment was filled with 0.1M $H_2SO_4$ solution. CO was presaturated into the catholyte and was continuously bubbling into the solution with a rate of 16 ml/min of CO during at least 1 h. The reaction applied potential was −2.5V vs Ag/AgCl during 8 h. Liquid aliquots were taken every hour and analyzed by Gas Chromatography (GC) and Fourier transform infrared spectroscopy (FTIR). Formaldehyde was not detected with GC, probably due to the product concentration is below the detection limit of the GC instrument.

Figure 8:
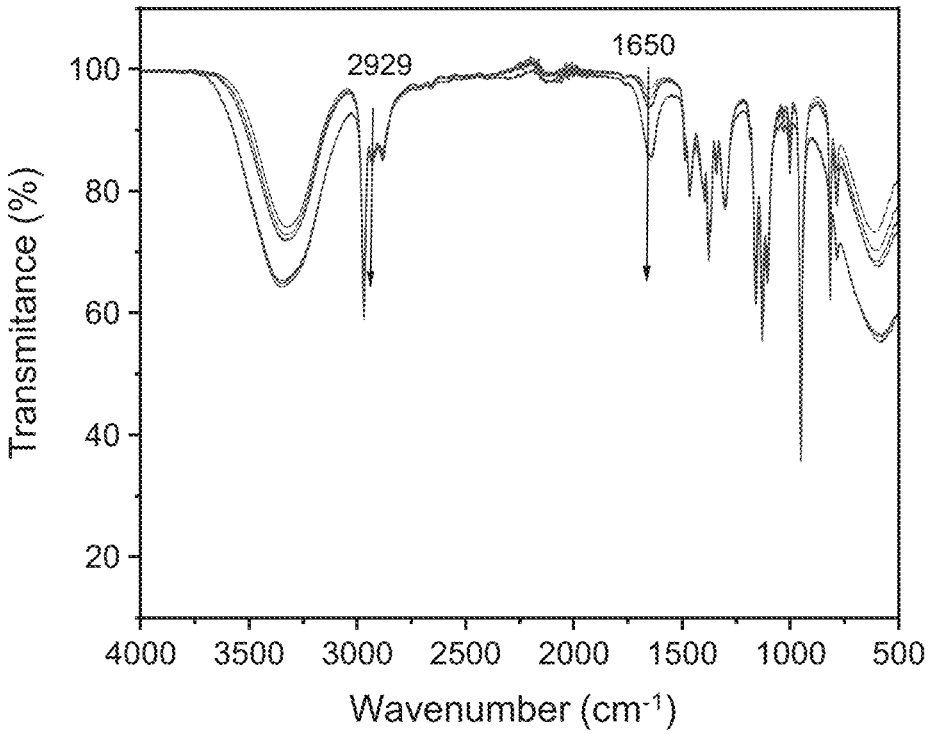
FIG. 8 illustrates the FTIR spectrum over time measured during the electrochemical reduction of CO in a tetraethylammonium chloride in isopropanol solution as electrolyte on BDD electrode at −2.5 V vs Ag/AgCl.

With a more sensitive technique (FTIR), the bands associated to formaldehyde were observed, and with increasing reaction time the spectral band associated with formaldehyde were increasing (see FIG. 8) The formaldehyde formation can be seen in the decrease of transmittance for the doublet C—H at about 2946 $cm^{-1}$ and the decrease of the peak at roughly 1651 $cm^{-1}$ that can be assigned to the carbonyl group.

The invention claimed is:

1. Process for the preparation of formaldehyde, said process comprising electrochemically reducing CO to form formaldehyde, wherein said electrochemically reducing CO is carried out in a supporting electrolyte comprising a non-aqueous solvent and comprising less than 50% water, based on the total weight of the solvent present in the supporting electrolyte, wherein the non-aqueous solvent comprises an alcohol.

2. Process according to claim 1, wherein the alcohol comprises one or more $C_1$-$C_8$ alcohols.

3. Process according to claim 1, wherein said supporting electrolyte comprises less than 20% water.

4. Process according to claim 1, wherein said supporting electrolyte further comprises a non-aqueous electrolyte solute, which is an electrolyte solute that is soluble in said non-aqueous solvent.

5. Process according to claim 1, wherein said electrochemically reducing CO to form formaldehyde is carried out in a cathodic compartment of an electrochemical cell, said cathodic compartment comprising a cathode comprising one or more of the group consisting of metals, carbon doped materials, and carbon-based materials.

6. Process according to claim 5, wherein the electrochemical cell further comprises an anodic compartment that is separated from the cathodic compartment by a cationic exchange membrane, an anionic exchange membrane or a bipolar membrane and wherein the process further comprises oxidizing a reducing agent in the anodic compartment.

7. Process according to claim 6, wherein said oxidizing a reducing agent in the anodic compartment comprises oxidizing water and/or hydroxide to oxygen and protons.

8. Process according to claim 5, wherein the cathode comprises, a plate electrode, a foam electrode, a mesh electrode (3-D electrode), a gas diffusion electrode, or a combination thereof.

9. Process according to claim 8, wherein the cathode comprises a gas diffusion electrode in which case the electrochemical cell also comprises a gas compartment that is in gaseous connection to the gas diffusion electrode.

10. Process according to claim 5, wherein the electrochemical cell comprises a microreactor, a filter press electrochemical flow cell or an H-cell.

11. Process according to claim 1, wherein the process is a batch, semi-continuous or continuous process.

12. Process according to claim 1, wherein the electrochemically reducing CO is carried out with a voltage in the range of −0.1 to −10 V vs Ag/AgCl cathode potential.

13. Process according to claim 1, wherein said electrochemically reducing CO is carried out at an atmospheric pressure or higher.

14. Process according to claim 1, wherein said electrochemically reducing CO is carried out at a temperature between 0 and 150° C.

15. Process according to claim 1, said process further comprising providing a stream comprising CO and leading said stream into an electrochemical cell before said electrochemically reducing the CO to form formaldehyde.

16. Process according to claim 1, wherein the alcohol comprises methanol.

17. Process according to claim 1, wherein said supporting electrolyte comprises less than 5% water based on to total weight of the solvent.

18. Process according to claim 1, wherein said electrochemically reducing CO to form formaldehyde is carried out in a cathodic compartment of an electrochemical cell, said cathodic compartment comprising a cathode comprising boron doped diamond (BDD).

19. Process according to claim 1, wherein the electrochemically reducing CO is carried out with a voltage in the range of −0.1 to −5 V vs Ag/AgCl cathode potential.

20. Process according to claim 1, wherein said electrochemically reducing CO is carried out at a pressure of at least 20 bar.

21. Process according to claim 1, wherein said electrochemically reducing CO is carried out at a temperature between 20° C. and 90° C.

* * * * *